US005437429A

United States Patent [19]

Atlas

[11] Patent Number: 5,437,429

[45] Date of Patent: Aug. 1, 1995

[54] PICTURE HOOK HANGER

[76] Inventor: Jonah Atlas, 31 Longview Dr., Eastchester, N.Y. 10709

[21] Appl. No.: 156,452

[22] Filed: Nov. 23, 1993

[51] Int. Cl.[6] ..... A47G 1/16

[52] U.S. Cl. ..... 248/493; 248/497; 248/547

[58] Field of Search ..... 248/467, 489, 493, 480, 248/497, 496, 547, 475.1

[56] References Cited

U.S. PATENT DOCUMENTS

| | | | |
|---|---|---|---|
| 2,137,837 | 11/1937 | Freudenberger . | |
| 2,635,840 | 4/1953 | Barry | 248/497 |
| 2,657,887 | 11/1953 | White | 248/497 X |
| 2,877,972 | 3/1959 | Sutton | 248/493 X |
| 3,226,065 | 12/1965 | Smith . | |
| 3,982,719 | 9/1976 | Kilborne . | |
| 4,641,807 | 2/1987 | Phillips | 248/480 |
| 4,775,129 | 10/1988 | Gleisten . | |
| 4,871,140 | 10/1989 | Hoskinson | 248/496 |
| 5,069,412 | 12/1991 | Jacob . | |
| 5,267,719 | 12/1993 | Keller | 248/475.1 X |

FOREIGN PATENT DOCUMENTS

| | | | |
|---|---|---|---|
| 77152 | 7/1950 | Norway | 248/497 |

*Primary Examiner*—J. Franklin Foss

*Attorney, Agent, or Firm*—Cohen, Pontani, Lieberman, Pavane

[57] ABSTRACT

A self adjusting two-piece picture hanger comprising a V-shaped spacer retainer member having angularly aligned through-holes in the respective legs of the V, for angled nail insertion. The second piece is an integral, dual hook member having an extension element, with a nail accommodating aperture. The extension element is adapted to be inserted between the legs of the spacer retainer member and the aperture thereof is brought into internal alignment between the through-holes thereof. At least one spacer element, such as a dimple or bent section, integral with the V-shaped spacer retainer member, keeps the respective legs of the V from compressively engaging the extension element, with insertion of a nail through the aligned through-holes and aperture. The extension element and dual-hook member remain free to pivot on the nail, for gravity induced alignment of the picture, mirror, clock or other item supported by the dual hook member.

12 Claims, 1 Drawing Sheet

PICTURE HOOK HANGER

FIELD OF THE INVENTION

This invention relates to hangers for hanging decorative objects on a wall and particularly to nail-in picture hook type hangers.

BACKGROUND OF THE INVENTION

One of the most common type of picture hook hangers is the nail-in picture hook hanger which comprises a bent strip of stiff metal. The metal strip is bent to form a hook portion, upon which the picture (mirror, clock, decorative trivets, etc.) is hung; and the strip is also bent to form an apertured angled guide, through which the nail is inserted and hammered in, at a downwardly extending angle for support (some hangers utilize sharp needle-like brads or nails which can be manually pushed into a wall).

A problem with many of the variations of this type of picture hook hanger, as exemplified by the various designs disclosed in U.S. Pat. Nos. 2,137,837; 3,226,065; 3,982,719; and 5,069,412; is that hammering-in of the supporting nail fixes the picture hook solidly against the wall. Thus, if the picture hook hanger is slightly askew, it remains in the skewed position, unless the nail is loosened by the weight of a picture or other item being hung thereon. However, a loosened nail (or an incompletely hammered-in nail) becomes very susceptible to complete unintended removal from the wall, particularly from walls made of crumbly gypsum panelling or plaster. Picture hook hangers of the type exemplified in U.S. Pat. No. 4,775,129, which are floatingly supported by pre-installed nails, have the disadvantage of being readily dislodged from the nail support.

SUMMARY OF THE INVENTION

In general, the present invention comprises a self adjusting two-piece hook hanger, particularly for use with pictures, comprising a wall anchored retention member and an object holding member. The wall anchored retention member comprises means for permitting the fixed position anchoring thereof to a wall with a nail. The object holding member comprises means for holding objects thereon, preferably with two hook elements, and means for permitting supported engagement with the nail. The wall anchored retention member further comprises means for retaining the object holding member against removal or dislodgment from the engaged supporting nail, while permitting the object holding member to floatingly move on the engaged supporting nail to self adjust, relative to the force of gravity. Alignment of the picture, clock, mirror, etc. is therefore effected automatically, without loosening of the supporting nail.

In a preferred embodiment, the retention member comprises elements which space the object holding member from the wall and from the head of the supporting nail. The spacing elements are, in turn, sufficiently removed from the object holding member to permit relatively free movement of the object holding member, to an extent required for the automatic gravity alignment. The retention member and object holding member are coincidently apertured to permit engagement of a nail with both members and the wall, for the supported retention of the object holding member and an object held thereon.

It is an object of the present invention to provide a nail-in picture hook hanger having means for permitting pictures, hung thereon, to be automatically self aligned by gravity inducement.

It is a further object of the present invention to provide such picture hook hanger, with reduced susceptibility of nail loosening.

It is a still further object of the present invention to provide such picture hook hanger with minimized susceptibility to accidental dislodgment.

These and other objects, features and advantages of the present invention will become more evident from the following discussion and drawings in which:

SHORT DESCRIPTION OF THE DRAWINGS

DETAILED DESCRIPTION OF THE INVENTION

The self adjusting two-piece nail-in wall hanger of the present invention preferably comprises a first U or V-shaped spacer retainer member having angularly aligned through-holes in the respective legs of the U or V, for angled nail insertion. Hereinafter, the designation "V-shape" shall be deemed to encompass the "U-shape" as well. The second member comprises an integral, dual hook, object holding member comprising a body element from which the hooks extend and an extension element, with an aperture therein, for supporting nail insertion therethrough. The extension element is adapted to be positioned between the legs of the spacer retainer member. The nail aperture of the object holding member and the through-holes in the legs of the spacer retainer or retention member are thereby brought into angled alignment for insertion of a single nail through the aperture and through-holes.

At least one spacer element, such as a dimple or bent section, integral with the spacer retainer member, keeps the respective legs thereof from compressively engaging the extension element, with the hammered in insertion of a nail through the aligned aperture and through-holes. Positioning of the spacer elements relative to the extension element should be such that they do not overly impede movement of the extension element, object holding member, and dual-hooks. The extension element should remain free to pivot on the nail, in an arc of at least 15°, in either direction from plumb, for gravity induced alignment of the picture, mirror, clock or other item supported by the dual hooks.

With pivoting over an arc of 15° in either direction, for a 30° total pivoting compensation, nearly all normal errors of off-plumb wall affixations can be automatically compensated for. With judicious placement of the spacer elements and undercutting of the extension element, it is possible to loosely capture the extension element (and the object holding member) within the retention member, by means of the spacer elements, whereby the retention member and object holding members can be handled as a unit, without the necessity of nail hole alignment therebetween, or loss of one or the other of the members. In order to effect such loose capture, the spacer elements are positioned at the outer periphery of the undercuts.

DETAILED DESCRIPTION OF THE DRAWINGS AND THE PREFERRED EMBODIMENT

Figure 1:
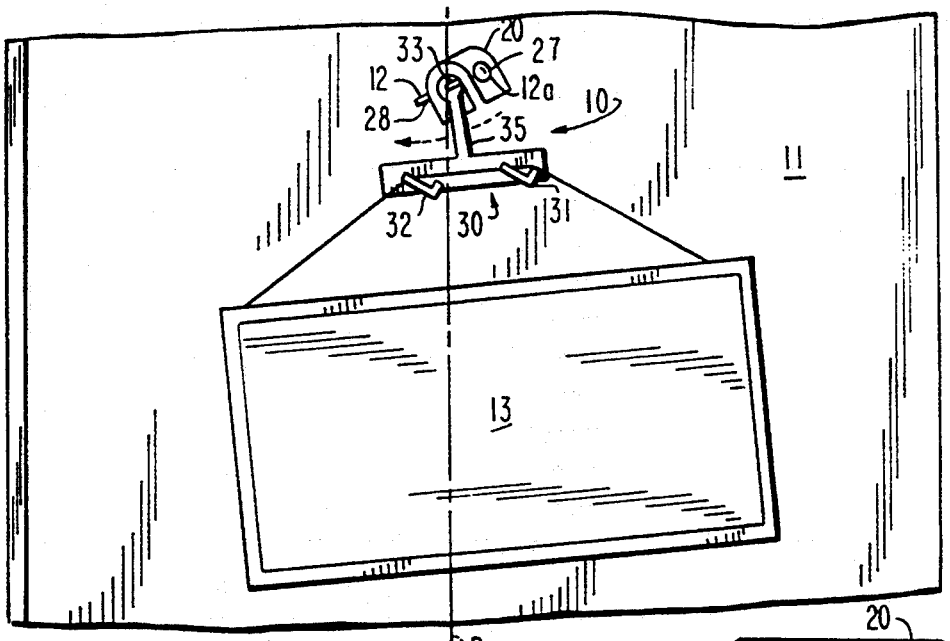
FIG. 1 is an opened, partially separated (for clarity) isometric view of the two piece nail-in hanger, of the present invention, as fastened to a wall for the hanging of a picture thereon, showing the self alignment.

With specific reference to the drawings, in FIG. 1, a two piece picture hook hanger 10 (shown separated for clarity) is shown fastened to a wall 11 by nail 12. Picture 13 is hung on spaced apart hooks 31 and 32 and, as shown by plumb line P, the hung picture 13 is slightly askew. However, as shown by the dashed lines, hanger member 30, with hooks 31 and 32, is free to pivot on nail 12, against the force of gravity, whereby it automatically aligns itself and the picture 13, hung thereon, along the plumb line P.

Figure 2:
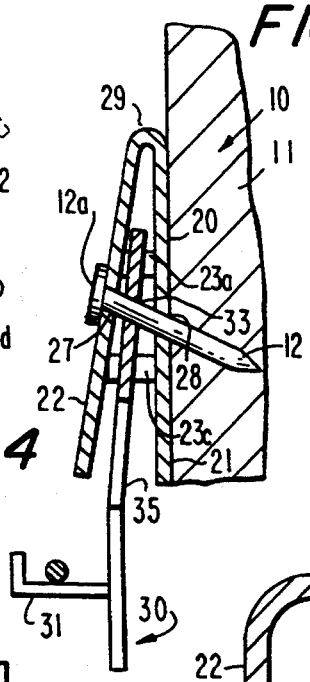
FIGS. 2 is a partially sectioned side view of the nail-in hanger of FIG. 1, as closed and fastened to the wall.
Figure 3:
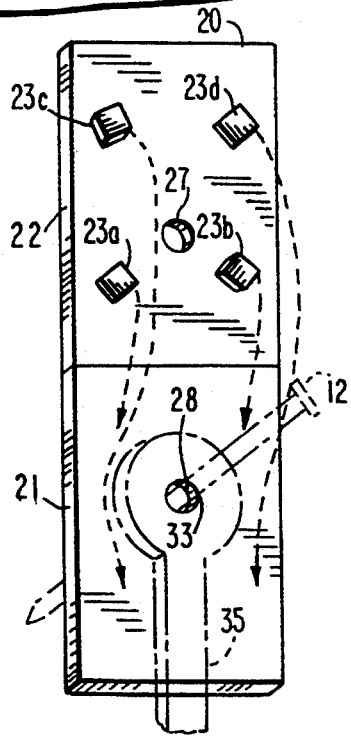
FIG. 3 is an isometric view of the retention member of the two piece nail-in hanger, prior to folding into its operational configuration, with positioning of the extension element of the hanger member, the nail, and the spacer elements shown in phantom.

As shown in FIG. 2, the picture hook hanger 10, comprises separate retention member 20 and hanger member 30. Retention member 20 is folded to be V-shaped with extending legs 21 and 22, between which extension element 35, of hanger member 30, is positioned for use. In FIG. 3, retention member 20 is shown prior to folding, with folding positioning of legs 21 and 22, spacer elements 23*a–d*, shown by the dashed arrows. Relative positioning with hanger member 30 and nail 12, is shown in phantom.

When the hanger 10 is to be used, aperture 33 in the extension element 35 is angularly aligned between through-holes 27 and 28 of the retention member 20. Nail 12 is therefore able to engage and pass through retention member legs 21 and 22, as well as hole 33, when the picture hook hanger 10 is nailed to the wall, with a downward supportive angle. Retention member leg 21 prevents the extension element 35 from being compressively engaged with wall 11 and retention member leg 22 spaces the extension element 35 from compressive engagement with the head of nail 12*a*.

The retention member legs 21 and 22 are themselves prevented from compressive engagement with extension element 35 by means of spacer elements 23*a–d*, which extend between the interior surfaces of legs 21 and 22 for a distance at least slightly more than the thickness of the extension element. The spacer elements 23*a–d* are integrally formed from leg 22, and extend between the legs, around the periphery of the extension element 35. As shown in FIG. 3 and more clearly seen in FIG. 4 (with leg 22 shown removed for clarity), though spacer elements 23*a* and 23*b* may be closely adjacent extension element 35, spacer elements 23*c* and 23*d* are removed from proximity to extension element 35 for a sufficient distance to permit the extension element 35 to pivot through at least a 30° arc (15° in each lateral direction) before laterally engaging such spacer elements.

Figure 4:
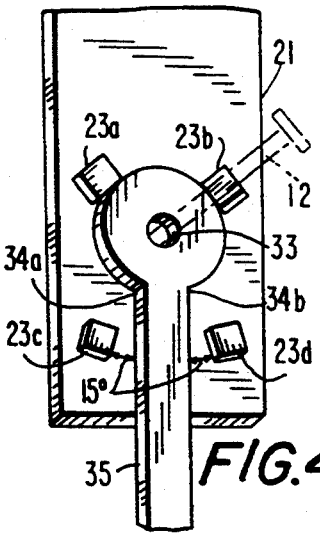
FIG. 4 is an isometric view of the extension element as positioned within the retention member, with the front leg of the retention member removed for clarity.

Preferably, the spacer elements vary in length, with the ones, 23*c* and 23*d*, furthest from the bend 29 of the V, being longer than spacer elements 23*a* and 23*b*, as shown in FIGS. 2 and 4, (spacers 23*d* and 23*b* are not visible in the cross section view of FIG. 2), whereby leg 22 is appropriately angled and retained for greater structural holding power and stability. In addition, as shown in FIG. 4, extension element 35 is provided with undercuts 34*a* and 34*b* as embodied in the circular head structure shown. Spacer elements 23*c* and 23*d* are positioned at the outer periphery of the undercuts 34*a* and 34*b* respectively whereby extension element 35 is floatingly connected with the retention element 20 when legs 21 and 22 are positioned and closed over the head of the extension element 35. The loose combination allows the picture hanger 10 to be handled as a unit and permits limited free pivoting movement of the extension element 35, hanger body 30 with hooks 31 and 32 for a sufficient distance to permit the automatic self alignment shown in FIG. 1.

Figure 5:
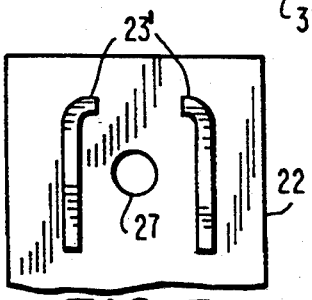
FIG. 5, is an alternative configuration of the spacer elements, shown as raised partial crescents.
Figure 6:
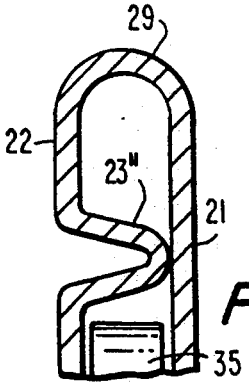
FIG. 6, depicts another alternative configuration of the spacer element as a folded portion of the retention member.

The spacer elements may be the simple dimple sections as shown in FIGS. 1–4 or they may comprise arced sections 23' in FIG. 5 or fold 23" of FIG. 6. Depending on their configuration they may vary in number, provided that they maintain spacing between the legs and the extension member even when nail 12 and outer leg 22 are hammered during nail installation.

It is to be understood that the drawings are not necessarily drawn to scale but that they are merely conceptual in nature. further understood that the above discussion of the preferred embodiments, as well as the embodiments depicted in the drawings are illustrative of the present invention and that changes in structure, configuration, components, relative positioning of the various elements including, but no limited to, substitution of elements from one embodiment to another, and the like are possible without departing from the scope of the present invention as defined in the following claims.

What is claimed is:

1. A self adjusting wall hanger, comprising:

a securing member;

a V-shaped retention member having opposing legs with an aperture in each leg, said leg apertures being aligned and offset from each other to allow for angled insertion of said securing member for anchoring one of said legs to a wall, thereby securing said retention member to the wall; and an object holding member comprising means for holding an object thereon, said object holding member having an extension element adapted for fitting between said opposing legs and having an aperture therein configured for alignment with said leg apertures, said object holding member being secured to said retention member and to the wall by said securing member and being floatingly moveable relative to said retention member and said securing member, to allow said holding member to self adjust relative to the force of gravity.

2. The wall hanger of claim 1, wherein said securing supporting nail.

3. The wall hanger of claim 2, wherein said opposing legs are spaced from each other and from the extension element therebetween by spacer means.

4. The wall hanger of claim 3, wherein said spacer means comprises at least one extension element between the opposing legs and peripherally adjacent the extension element and wherein said at least one extension element and an opposing leg, furthest from the wall, further comprise a means for retaining the object holding member against removal from the engaged supporting nail, while permitting the object holding member to floatingly move on the engaged supporting nail to self adjust, relative to the force of gravity.

5. The wall hanger of claim 4, wherein said spacer means are adapted to maintain a V-shape configuration when the hanger is attached to the wall with said nail.

6. The wall hanger of claim 4, wherein said spacer means comprises four dimpled sections, each being integral with either of said opposing legs, with said dimples being arranged such that they peripherally enclose a portion of the extension element having the aperture therein.

7. The wall hanger of claim 4, wherein said spacer means comprises one or more elongated sections positioned and configured to peripherally enclose a portion of the extension member having the aperture therein.

8. The wall hanger of claim 4, wherein said spacer means comprises one or more folds of at least one of said opposing legs.

9. The wall hanger of claim 4, wherein said means for holding an object on said object holding member comprises two hooks, extending outwardly from said wall, when the wall hanger is attached thereto, and adapted to engage an object thereon.

10. The wall hanger of claim 9 wherein said spacer means permits said floating movement for at least 15° in directions lateral to the direction of the force of gravity.

11. The wall hanger of claim 9, wherein said spacer means are adapted to peripherally enclose a portion of the extension element, whereby said extension element is retained therebetween and said wall hanger is thereby handled as a unit.

12. The wall hanger of claim 11, wherein said portion of the extension element comprises an undercut whereby said spacer means are positioned within said undercut to prevent removal of the extension element from between the opposing legs of the retention member.

* * * * *